US005995635A

United States Patent [19]

Fletcher

[11] Patent Number: 5,995,635

[45] Date of Patent: Nov. 30, 1999

[54] SOUND PICKUP AND AMPLIFIER APPARATUS FOR VIBRATING STRINGS

[76] Inventor: William Fletcher, 92 Thompson Rd., Westmoreland, N.H. 03467

[21] Appl. No.: 08/908,837

[22] Filed: Aug. 8, 1997

[51] Int. Cl.[6] ..... H04R 25/00

[52] U.S. Cl. ..... 381/162; 381/161; 381/150; 244/153 R

[58] Field of Search ..... 244/153 R, 155 A, 244/153 A, 155 R; 381/162, 161, 150

[56] References Cited

U.S. PATENT DOCUMENTS

| | | | |
|---|---|---|---|
| 1,377,521 | 5/1921 | Oulianine | 381/162 |
| 1,915,858 | 6/1933 | Miessner | 381/162 |
| 1,929,030 | 10/1933 | Miessner | 381/162 |
| 4,495,641 | 1/1985 | Vernino | 381/162 |
| 4,752,051 | 6/1988 | Chang | 244/155 R |

*Primary Examiner*—Sinh Tran

*Attorney, Agent, or Firm*—William B. Ritchie; Michael J. Persson

[57] ABSTRACT

An apparatus to pick up and amplify sounds created by vibrations of a flexible member having a base which supports a sound pick up that transmits a signal to an amplifier. The apparatus is attached to the flexible member by an attachment assembly mounted on the base at an approximate center of gravity of the apparatus. The attachment assembly has two points of attachment such that when the flexible member is under tension a rotational force around the attachment assembly brings the sound pick up close to or in contact with the flexible member. The apparatus may also have the sound pick up mounted to a speaker that is mounted to the base. The apparatus may also have the sound pick up mounted to the base and transmit a signal to a separate amplifier.

22 Claims, 7 Drawing Sheets

SOUND PICKUP AND AMPLIFIER APPARATUS FOR VIBRATING STRINGS

BACKGROUND OF THE INVENTION

1. Field of the Invention

The invention relates to the removable addition of sound pick up and amplification to strings and in particular kite strings that are under varying tensions and have varying vibrations.

2. Description of the Related Art

A number of devices exist for creating sound while flying a kite. In all of these devices sound is created by a feature added to the functional structure of the kite. U.S. Pat. No. 4,752,051, issued to Chang on Jun. 21, 1988, discloses a rotating device that creates sound. The device is intended to be attached to a kite string. When the device is in operation, air flow causes a windsail to rotate, which in turn rotates a plucking device that strikes a spring to make a clicking sound. This device is attached to the kite string by cutting the string and tying either end to either side of the device, which makes attaching and removing the device inconvenient. Use of this device also requires that it be attached to the string prior to launching the kite.

U.S. Pat. No. 4,634,085, issued to Cuesta et al. on Jan. 6, 1987, discloses a kite structure that incorporates a device with the sole purpose of creating sound. This device mounted on the body of the kite uses a flexible strap that vibrates in the air to create a sound. This device is intended to be a permanent feature of the kite and thus would not be easy to remove or install.

U.S. Pat. No. 2,800,293, issued to Kindelberger et al. on May 4, 1954, discloses a propeller to be mounted on a kite to help control the kite as well as create sound. Air passing through openings in the rotating propeller blades creates a buzzing sound. The propeller is intended to be a permanent feature of the kite and has to be mounted on the body of the kite before the kite is airborne. U.S. Pat. No. 4,336,915, issued to Stoecklin et al. on Jun. 29, 1982, also discloses a kite structure that incorporates a rotating device mounted on the body of the kite. In this patent whistles attached to the blades of the rotating device create sounds as air passes through them.

Other devices intended to be attached to kite strings exist in the prior art. U.S. Pat. No. 4,842,222, issued to Baird on Jun. 27, 1989, discloses a device that enables kites to carry loads upwards for release. One part of this device is fixedly attached to a kite string. The device and the load must be attached to the string before the kite is airborne. U.S. Pat. No. 3,583,662, issued to Bury on Jun. 8, 1971, discloses another device that enables kites to carry loads upwards for release. All of the described embodiments of this device have at least one part that is fixedly attached to the kite string and must be attached before the kite is airborne. Neither of these two devices creates or amplifies sound.

In the present invention, the sound to be picked up and amplified is that created by the vibrations of a string under tension. When used on a kite string, the apparatus picks up and amplifies the sound created by the vibrations of the kite string caused by the wind.

The known devices for creating sound while flying a kite are either permanent features of the kite itself or attached to the string in a way that damages the string and makes removal difficult. None of the devices in the prior art are easily attached and removed. It would be an improvement on the current art to create an apparatus for the pick up and amplification of sounds created by the vibrations of a string that can be easily attached and removed from any string. The present invention discloses an apparatus that can be easily and quickly attached to a string, and just as easily and quickly removed. The apparatus can be attached to a string while it is under tension during kite flying or before the kite is airborne while the string is not under tension.

None of the devices in the prior art allow the user to disable the sound creating function without removing the device from the kite or the string. It would be an improvement on the current art to create an apparatus that would allow a user to disable the sound creating function while the apparatus remains attached to a string under tension.

SUMMARY OF THE INVENTION

It is an aspect of the invention to provide an apparatus to pick up and amplify the sound created by vibrations of a string under tension.

It is a further aspect of the invention to provide an apparatus to pick up and amplify the sound created by vibrations of a kite string under tension, where the vibrations are created by wind.

It is a further aspect of the invention to provide an apparatus to pick up and amplify the sound created by vibrations of a string under tension that is easily attached and removed from any string.

It is a further aspect of the invention to provide an apparatus to pick up and amplify the sound created by vibrations of a string under tension that can be attached and removed from a string while under tension and while not under tension.

It is a further aspect of the invention to provide an apparatus to pick up and amplify the sound created by vibrations of a kite string under tension that can be attached and removed from the kite string while the kite is airborne and while the kite is not airborne.

It is a final aspect of the invention to provide an apparatus to pick up and amplify the sound created by vibrations of a string under tension that allows the temporary disabling of the pick up and amplification of the sound while the string is under tension.

The invention is an apparatus to pick up and amplify the sounds created by the vibrations of a flexible member. The apparatus comprises a base that supports a sound pick up that transmits a signal to an amplifier. The apparatus is attached to a flexible member by an attachment assembly that is mounted on the base at an approximate center of gravity of the apparatus. The attachment assembly comprises two points of attachment such that when the flexible member is under tension a rotational force is created around the attachment assembly and the sound pick up is brought close to or into contact with the flexible member. In one embodiment of the invention, the attachment assembly comprises two supports, each comprising a post and a pin. The two supports are oriented such that the pins are parallel to each other and perpendicular to the horizontal axis of the base. In another embodiment of the invention, the attachment assembly comprises one post and two pins. In another embodiment of the invention, the attachment assembly comprises one post and one pin having a recess shaped to provide the two points of attachment. In a further embodiment of the invention, the attachment assembly comprises one post, a link mounted to the post by a pin, and a second pin mounted on the link. In another embodiment of the invention the sound pick up is mounted to an amplifier in the form of a speaker mounted to the base. In another embodiment of the invention the sound pick up is mounted to the base and transmits a signal to a separate amplifier.

DETAILED DESCRIPTION OF THE INVENTION

Figure 1:
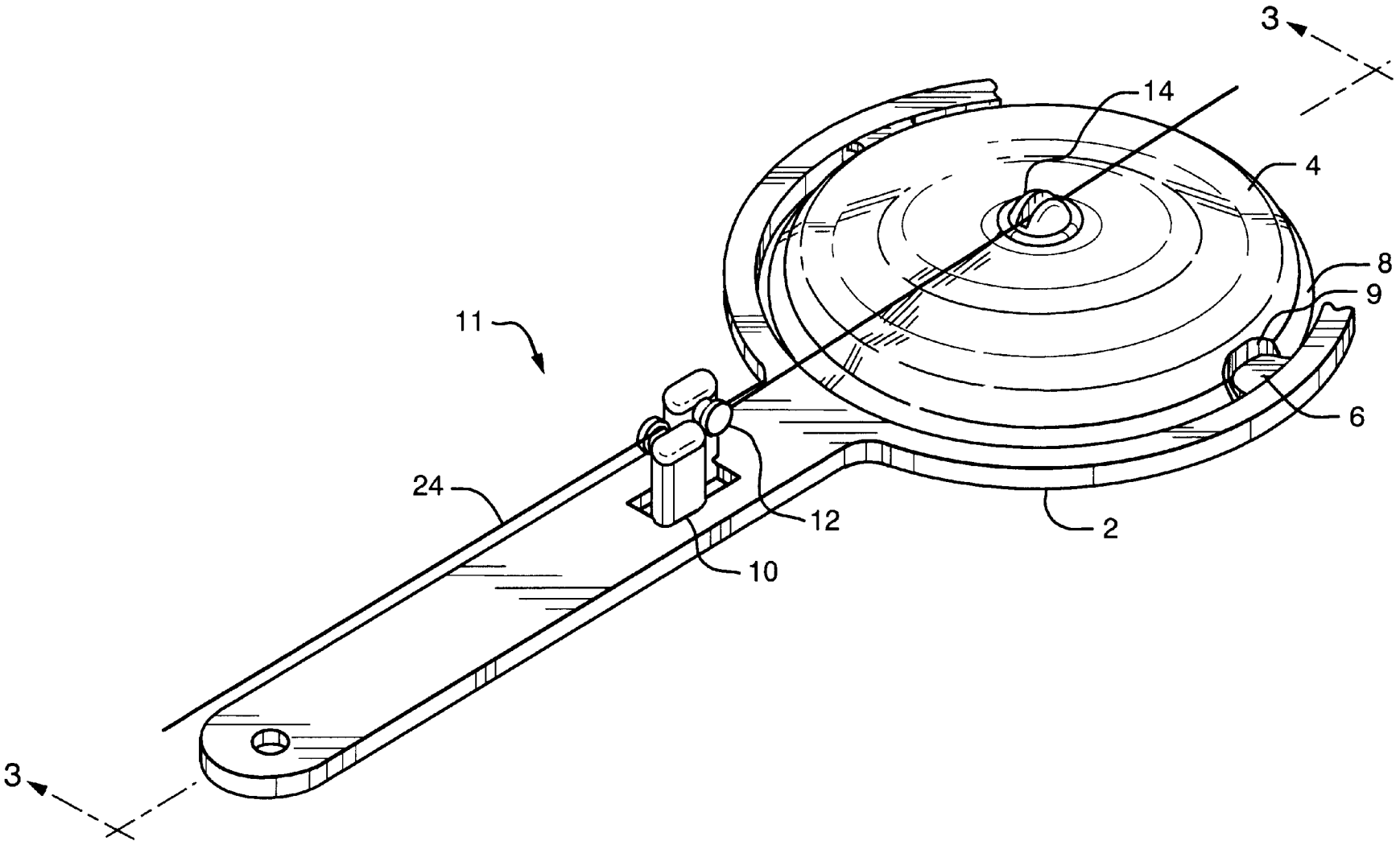
FIG. 1 is an orthogonal view of the preferred embodiment of the present invention attached to a string under tension, wherein the embodiment features mechanical sound pick up and amplification.

Referring first to FIG. 1, the invention 11 consists of a base 2 in the shape of a fork. Base 2 supports a speaker 4 by means of multiple tabs 6 and 8 staggered alternately and radially above and below the rim of the speaker 4. At least one upper tab 6 fits into a recess 9 which maintains the orientation of the speaker 4 and sound pick up 14, mounted on speaker 4. The sound pick up 14 will then be kept parallel with a horizontal axis 3 of the invention 11.

The invention 11 is mounted on a string 24 by an attachment assembly, which comprises a pair of posts 10 each supporting a pin 12. The posts 10 are oriented to create a path for the string 24 when the string 24 is under tension, as shown. The pins 12 do not touch an opposite post 10 or each other. This attachment assembly of posts 10 and pins 12 is mounted on the base 2 at an approximate center of gravity of the invention 11. When attached to a string under tension, this arrangement creates a rotational force around the attachment assembly that tends to force the sound pick up 14 on the speaker 4 into contact with the tense string 24. This contact creates an efficient transfer of vibrations from the string 24 to the sound pick up 14 and thus onto the speaker 4.

Figure 2:
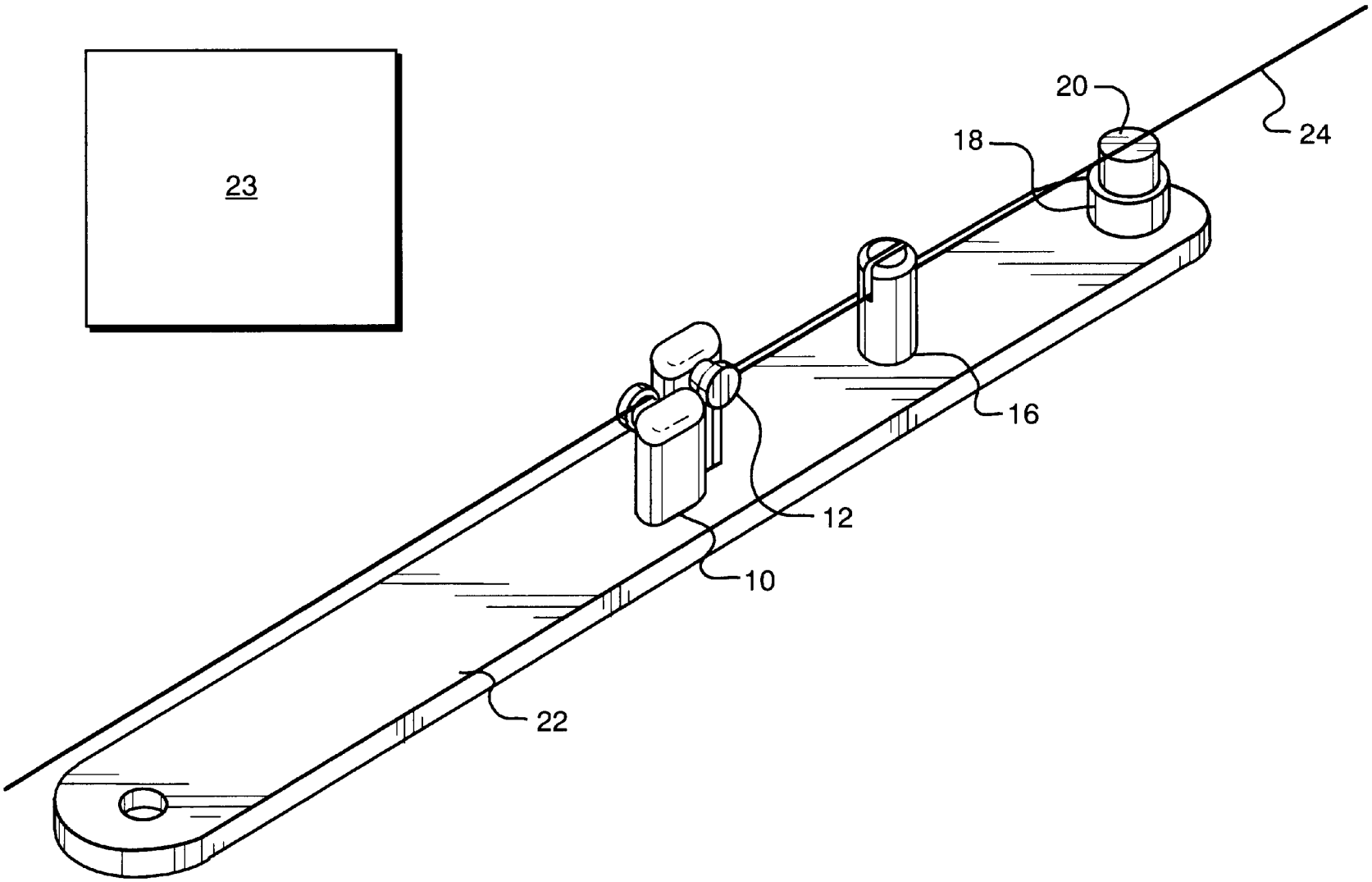
FIG. 2 is an orthogonal view of another embodiment of the present invention attached to a string under tension, wherein the embodiment features electrical sound pick up and a separate electronic amplifier.

The conical shape of the speaker 4 serves to amplify the vibrations of the string 24. Speakers made of different materials and different densities will change the characteristics of the amplified sound. Different speakers may be easily interchanged in this embodiment without the use of tools. The sound pick up and amplification may also be temporarily disabled without removing the invention 11 from a string simply by lifting the end of the fork so that the sound pick up 14 is not in contact with the string. This embodiment may also be easily manufactured in two parts: the base and the speaker with an integrally mounted sound pick up. This embodiment of the invention may be made of a light material, such as plastic, so that a kite string will support the invention during kite flying. However, other light materials well known in the art may be used Referring now to FIG. 2, an alternate embodiment of the invention 11 consists of a base 22 with a horizontal axis 3. Base 22 supports a pick up holder 18, which in turn supports an electronic pick up 20. The invention 11 is mounted on a string 24 by an attachment assembly, which comprises a pair of posts 10 each supporting a pin 12. The posts 10 are oriented to create a path for the string 24 when the string 24 is under tension, as shown. The pins 12 do not touch an opposite post 10 or each other. This attachment assembly of posts 10 and pins 12 is mounted on the base 2 at an approximate center of gravity of the invention 11. When attached to a string under tension, this arrangement creates a rotational force around the attachment assembly that tends to force the electronic pick up 20 substantially close to the tense string 24. The electronic pick up 20 transmits a signal to a separate electronic amplifier 23.

A string guide 16 is mounted to the base between the pair of posts 10 and the electronic pick up 20 so as to maintain the tense string 24 substantially close to the electronic pickup 20. The different positions of the string guide 16 along the horizontal axis 3 of the base 22 will result in different pitches transmitted to the electronic pick up 20. The sound pick up and amplification may be temporarily disabled simply by lifting the end of the base so that the electronic pick up is not substantially close to the string. This embodiment of the invention may be easily manufactured as one piece. This embodiment of the invention may be made of a light material, such as plastic, so that a kite string will support the invention during kite flying. However, other light materials well known in the art may be used.

Figure 3:
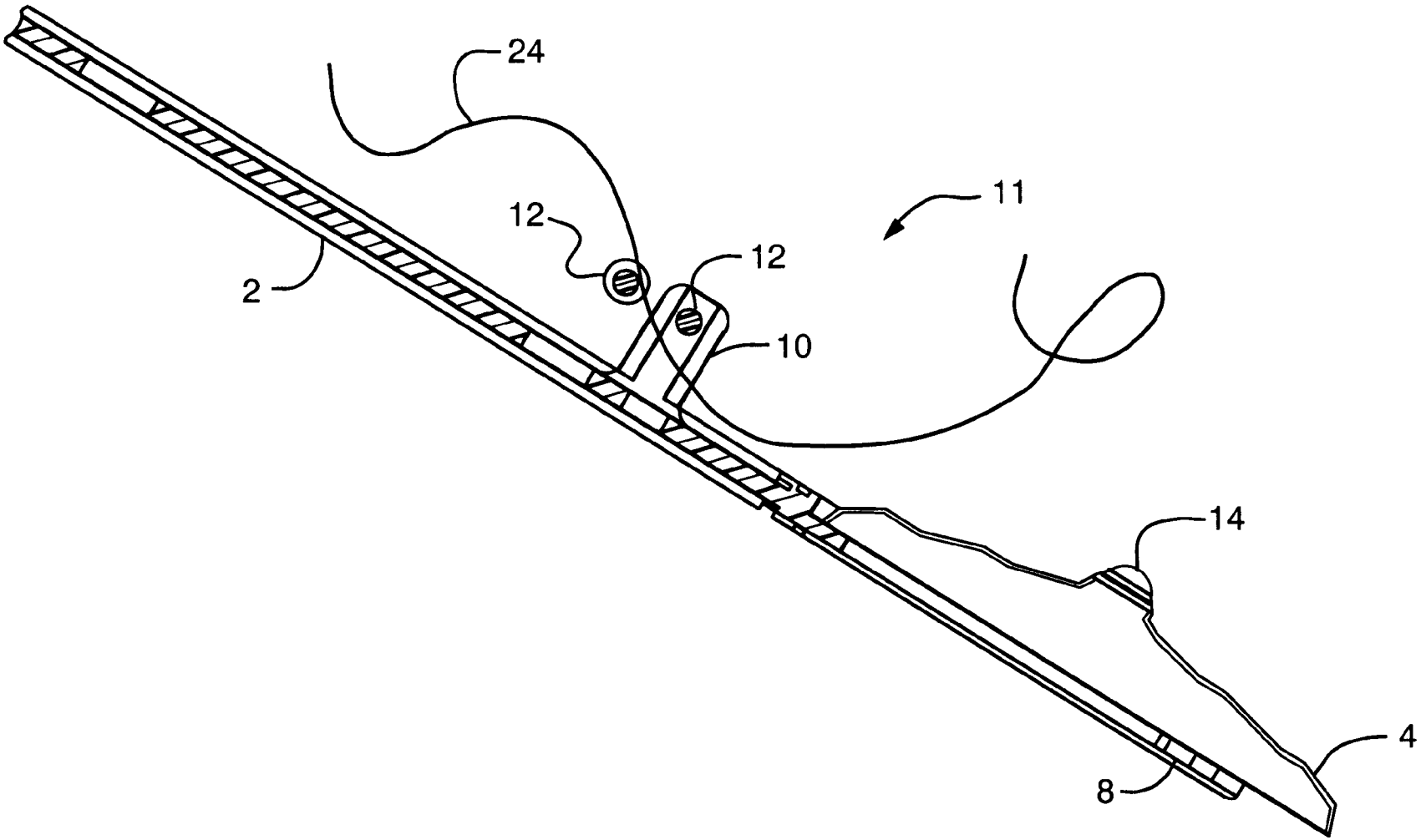
FIG. 3 is a sectional view of the embodiment of FIG. 1 across section line 3—3, where the invention is attached to a string not under tension.

Referring now to FIG. 3, a sectional view of the embodiment of FIG. 1 across section line 3—3 is shown attached to a string 24 that is not under tension. In this situation the sound pick up 14 is not in contact with the string 24. The string 24 is under the pin 12 closest to the speaker 4, and over the other pin 12.

Figure 4:
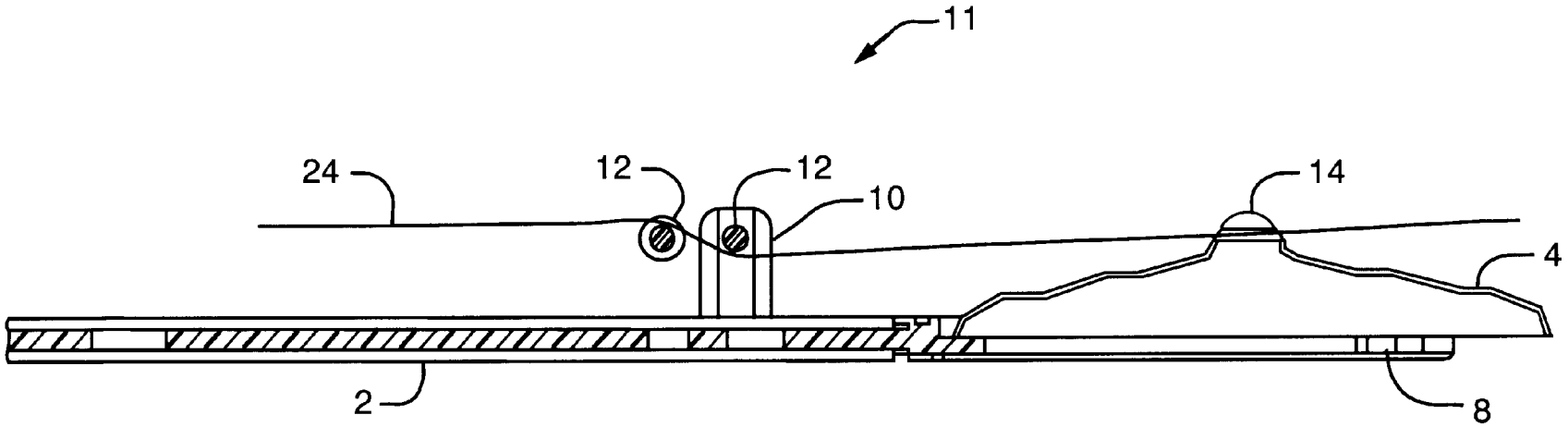
FIG. 4 is a sectional view of the embodiment of FIG. 1 across section line 3—3, where the invention is attached to a string under tension.

Referring now to FIG. 4, a sectional view of the embodiment of FIG. 1 across section line 3—3 is shown mounted to a string 24 that is under tension. In this situation the sound pick up 14 is in contact with the string 24. The string 24 is in the same position relative to the pins 12 as in FIG. 3.

Figure 5A:
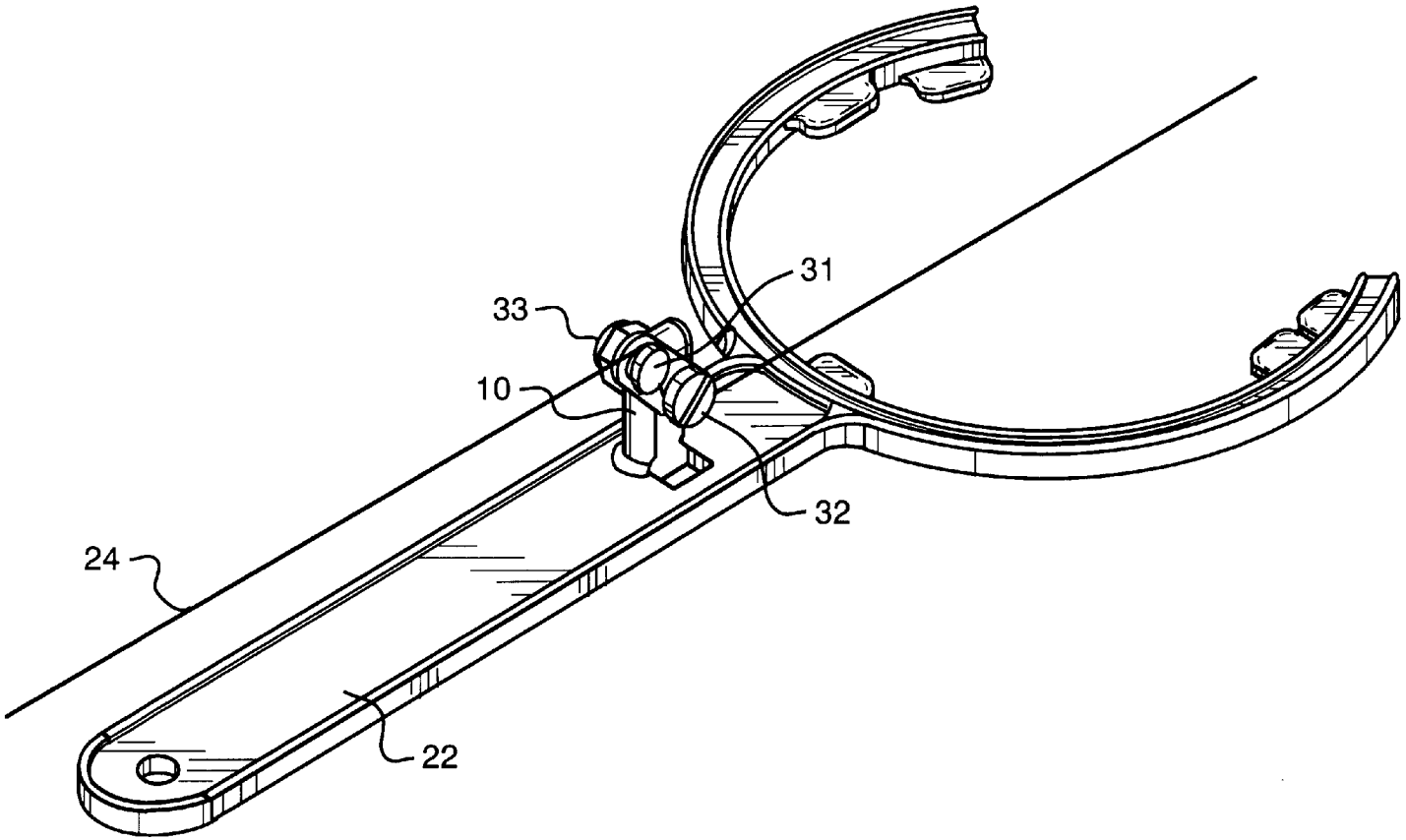
FIG. 5 is an orthogonal view of another embodiment of the invention.
Figure 5B:
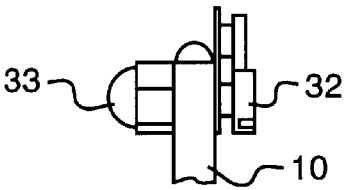

Referring now to FIG. 5, a further embodiment of the invention is shown featuring an alternate configuration of the attachment assembly. Post 10 is mounted on the base 22 at an approximate center of gravity of the invention 11. Link 30 is mounted on post 10 by a threaded pin 32. Pin 32 holds link 30 in place by tightening nut 33, and provides one point of attachment for string 24. A second pin 31 is mounted on link 30 to provide a second point of attachment for string 24. Rotating the link 30 around pin 32 changes the rotational force that is created around the attachment assembly when the invention is attached to a tense string.

Figure 6:
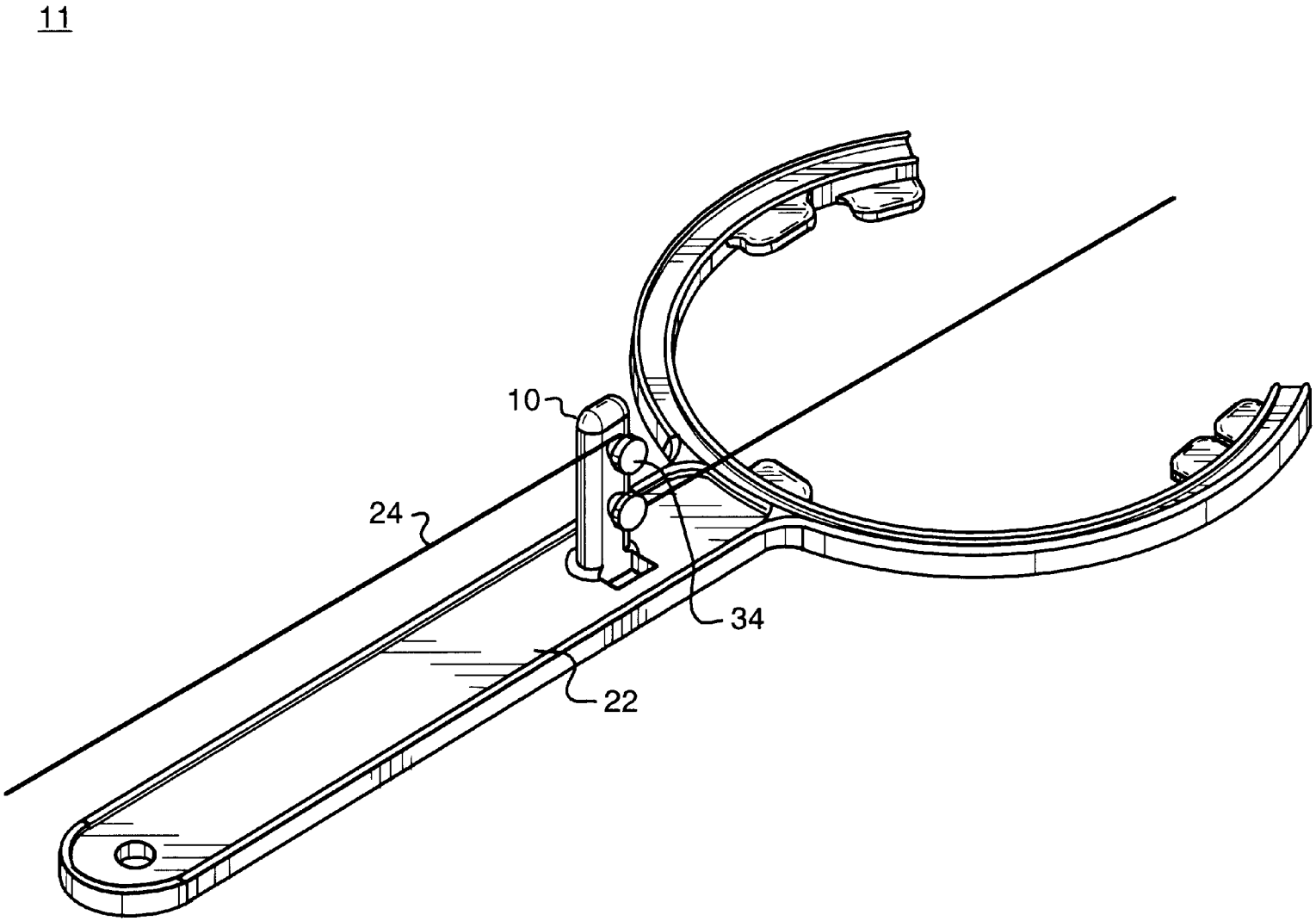
FIG. 6 is an orthogonal view of a further embodiment of the invention.

Referring now to FIG. 6, a further embodiment of the invention is shown featuring another alternate configuration of the attachment assembly. Post 10 is mounted on base 22 at an approximate center of gravity of the invention 11. Two pins 34 are mounted on post 10 vertically to provide two points of attachment for the string 24.

Figure 7A:
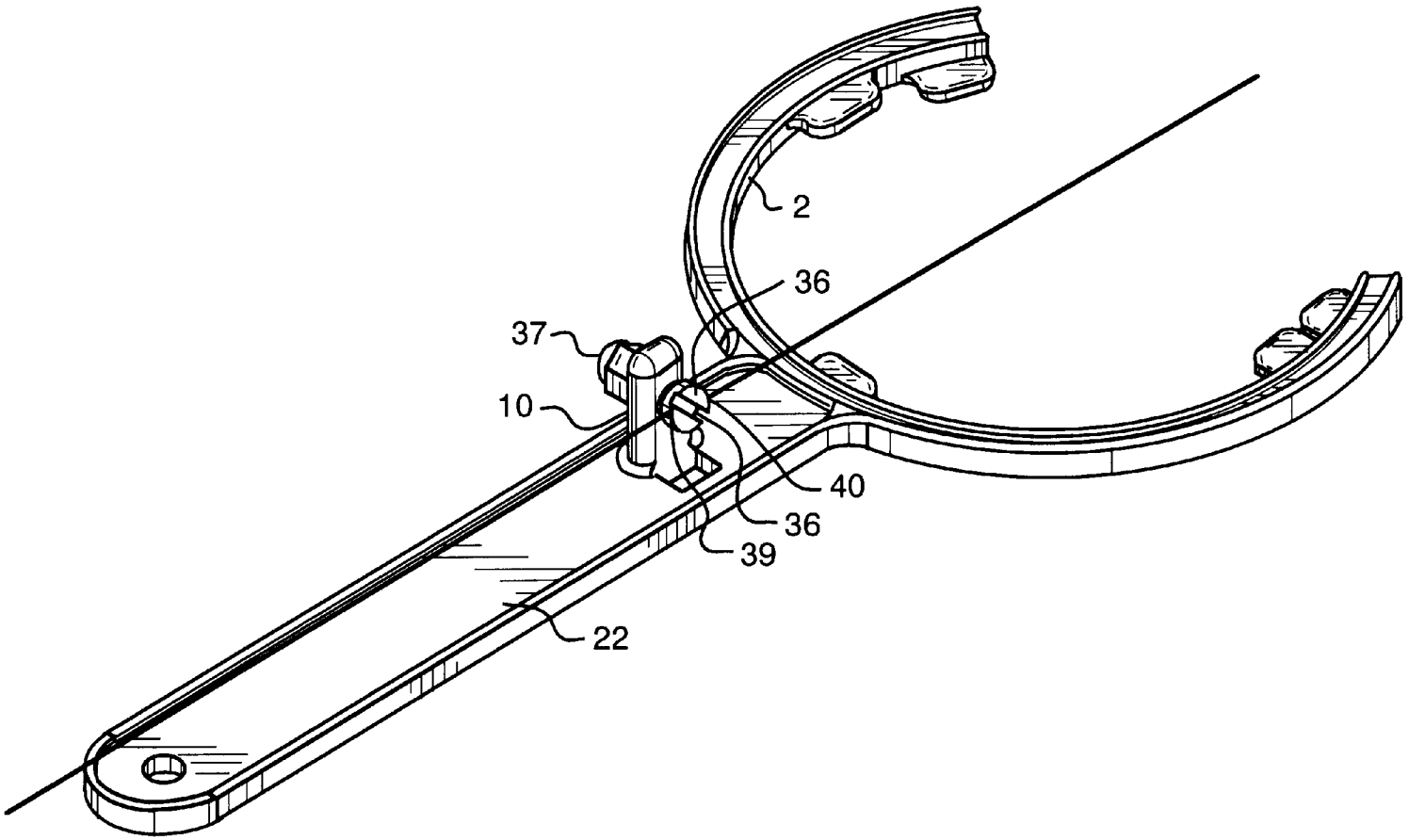
FIG. 7 is an orthogonal view of a still further embodiment of the invention.
Figure 7B:
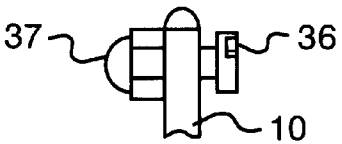

Referring now to FIG. 7, a further embodiment of the invention is shown featuring a further alternate configuration of the attachment assembly. The post 10 is mounted on base 22 at an approximate center of gravity of the invention 11. A threaded pin 36 is mounted on the post 10 and may be fixed into position by tightening nut 37. Pin 36 has a recess 38 providing two points of attachment 39 and 40. Rotating pin 36 changes the rotational force created around the attachment assembly when the invention is attached to a tense string 24. Rotating pin 36 towards the fork 2 will increase the rotational force and rotating pin 36 away from the fork 2 will decrease the rotational force.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An apparatus for the pick up and amplification of sounds created by vibrations of a flexible member comprising:

a base having a horizontal axis;

said base comprising a body member and a head member;

the head member of said base having a shape with an open aspect;

a speaker mounted inside the open aspect of the head member of said base;

a sound pick up mounted to said speaker;

an attachment assembly mounted to the body member of said base at an approximate center of gravity of the apparatus along the horizontal axis of said base;

said attachment assembly being adapted to receive the flexible member such that when the flexible member is under tension a rotational force is created around said attachment assembly such that said sound pick up is brought into contact with the flexible member such that the vibrations of the flexible member are transmitted to the speaker and amplified.

2. The apparatus of claim 1, wherein said attachment assembly further comprises two points of attachment such that when the flexible member is under tension and in contact with said two points of attachment the rotational force is created around said attachment assembly.

3. The apparatus of claim 2, wherein said attachment assembly further comprises:

at least one post having a vertical axis perpendicular to the horizontal axis of said base;

two substantially identical pins having a length;

each of said two substantially identical pins being mounted on said post such that the length of each of said two substantially identical pins is perpendicular to the vertical axis of said post;

each of said two substantially identical pins corresponding to one of said two points of attachment.

4. The apparatus of claim 2, wherein said attachment assembly further comprises:

two substantially identical supports;

each support comprising:

a post having a vertical axis perpendicular to the horizontal axis of said base;

a pin having a length, a width and an axis;

said pin being mounted on said post such that the length of said pin is perpendicular to the vertical axis of said post;

said two supports being oriented such that the length of each said pin is parallel to the length of said other pin and the axis of one said pin is offset a distance from the axis of said other pin;

said two supports being further oriented such that the widths of both said pins are parallel to the horizontal axis of said base;

each said pin corresponding to one of said two points of attachment.

5. The apparatus of claim 2, wherein said attachment assembly further comprises:

at least one post having a vertical axis perpendicular to the horizontal axis of said base;

a pin having a length;

said pin being rotatably mounted to said post such that the length of said pin is perpendicular to the vertical axis of said post;

said pin having a recess shaped to provide said two points of attachment.

6. The apparatus of claim 2, wherein said attachment assembly further comprises:

a post having a vertical axis perpendicular to the horizontal axis of said base;

a pin having a length;

said pin being rotatably mounted to said post such that the length of said pin is perpendicular to the horizontal axis of said base;

a link rotatably mounted to said pin;

a second pin mounted on said link;

said second pin corresponding to one of said two points of attachment;

said pin corresponding to one other of said two points of attachment.

7. The apparatus of claim 4, wherein said sound pick up is integrally mounted to said speaker.

8. The apparatus of claim 7, wherein said speaker is removably mounted to the head member of said base.

9. The apparatus of claim 8, wherein said sound pick up further comprises a recess shaped to receive the flexible member such that when the flexible member is under tension it is maintained in contact with said sound pick up.

10. The apparatus of claim 9, wherein said speaker has a conical shape.

11. The apparatus of claim 9, wherein the flexible member comprises a kite string.

12. The apparatus of claim 9, wherein said attachment assembly is adjustably mounted to the body member of said base along the horizontal axis of said base.

13. An apparatus for the pick up and amplification of sounds created by vibrations of a flexible member comprising:

a base having a horizontal axis;

an attachment assembly mounted on said base at an approximate center of gravity of the apparatus along the horizontal axis of said base;

a sound pick up mounted to said base along the horizontal axis of said base at a predetermined distance from said attachment assembly;

said attachment assembly being adapted to receive the flexible member such that when the flexible member is under tension a rotational force is created around said attachment assembly such that said sound pick up is brought into contact with the flexible member;

an amplifier capable of receiving a signal from said sound pick up such that the vibrations of the flexible member are transmitted to the amplifier and amplified.

14. The apparatus of claim 13, wherein said attachment assembly further comprises:

two points of attachment such that when the flexible member is under tension and in contact with said two points of attachment the rotational force is created around said attachment assembly.

15. The apparatus of claim 14, wherein said attachment assembly further comprises:

at least one post having a vertical axis perpendicular to the horizontal axis of said base;

two substantially identical pins each having a length;

each of said two substantially identical pins being mounted on said post such that the length of each of said two substantially identical pins is perpendicular to the vertical axis of said post;

each of said two substantially identical pins corresponding to one of said two points of attachment.

16. The apparatus of claim 14, wherein said attachment assembly further comprises:

two substantially identical supports;

each support comprising:

a post having a vertical axis perpendicular to the horizontal axis of said base;

a pin having a length, a width and an axis;

said pin being mounted on said post such that the length of said pin is perpendicular to the vertical axis of said post;

said two supports being oriented such that the length of each said pin is parallel to the length of said other pin and the axis of one said pin is offset a distance from the axis of said other pin;

said two supports being farther oriented such that the diameters of both said pins are parallel to the horizontal axis of said base.

17. The apparatus of claim 14, wherein said attachment assembly further comprises:

at least one post having a vertical axis perpendicular to the horizontal axis of said base;

a pin having a length;

said pin being rotatably mounted to said post such that the length of said pin is perpendicular to the vertical axis of said post;

said pin having a recess shaped to provide said two points of attachment.

18. The apparatus of claim 14, wherein said attachment assembly further comprises:

at least one post having a vertical axis perpendicular to the horizontal axis of said base;

a pin having a length;

said pin being rotatably mounted to said post such that the length of said pin is perpendicular to the horizontal axis of said base;

a link rotatably mounted to said pin;

a second pin mounted on said link;

said second pin corresponding to one of said two points of attachment;

said pin corresponding to one other of said two points of attachment.

19. The apparatus of claim 14 further comprising:

a guide mounted on said base between said attachment assembly and said sound pick up;

said guide having a recess shaped to receive the flexible member such that the flexible member is positioned close to said sound pick up.

20. The apparatus of claim 19, wherein said sound pick up further comprises:

a microphone;

a transmitter adapted to receive a signal from said microphone and transmit the signal to said amplifier.

21. The apparatus of claim 20, wherein the flexible member comprises a kite string.

22. The apparatus of claim 20, wherein said attachment assembly is adjustably mounted on said base along the horizontal axis of said base.

* * * * *